US009289057B2

(12) United States Patent
Dienes et al.

(10) Patent No.: US 9,289,057 B2
(45) Date of Patent: Mar. 22, 2016

(54) ITEM OF FURNITURE WITH A MOVABLE FURNITURE PART

(71) Applicant: USM Holding AG, Muri bei Bern (CH)

(72) Inventors: Thomas Dienes, Bern (CH); Alexander Schärer, Muri b. Bern (CH)

(73) Assignee: USM HOLDING AG, Muri Bei Bern (CH)

( * ) Notice: Subject to any disclaimer, the term of this patent is extended or adjusted under 35 U.S.C. 154(b) by 0 days.

(21) Appl. No.: 14/059,004

(22) Filed: Oct. 21, 2013

(65) Prior Publication Data

US 2014/0109802 A1 Apr. 24, 2014

(30) Foreign Application Priority Data

Oct. 22, 2012 (EP) ..... 12405113

(51) Int. Cl.
*A47B 9/00* (2006.01)

(52) U.S. Cl.
CPC ..... *A47B 9/00* (2013.01); *A47B 2200/0056* (2013.01); *A47B 2200/0062* (2013.01)

(58) Field of Classification Search
CPC ..... A47B 9/00; A47B 2200/0062; A47B 2200/0056
USPC ..... 312/330.1, 319.5–319.8; 108/20–22, 108/147
See application file for complete search history.

(56) References Cited

U.S. PATENT DOCUMENTS

| | | | | |
|---|---|---|---|---|
| 3,866,048 | A * | 2/1975 | Gieschen et al. | 378/91 |
| 4,107,590 | A * | 8/1978 | Pury et al. | 318/628 |
| 4,163,929 | A * | 8/1979 | Janu et al. | 318/628 |
| 4,440,096 | A | 4/1984 | Rice et al. | |
| 4,714,025 | A * | 12/1987 | Wallin et al. | 108/20 |
| 5,323,695 | A * | 6/1994 | Borgman et al. | 108/147 |
| 6,360,675 | B1 * | 3/2002 | Jones | 108/50.02 |
| 7,538,284 | B2 * | 5/2009 | Nielsen et al. | 200/296 |
| 2003/0122459 | A1 * | 7/2003 | Huber et al. | 312/319.6 |
| 2007/0200396 | A1 | 8/2007 | Baumann et al. | |
| 2009/0078167 | A1 * | 3/2009 | Ellegaard | 108/21 |
| 2012/0087480 | A1 * | 4/2012 | Yang et al. | 378/197 |

FOREIGN PATENT DOCUMENTS

| | | | |
|---|---|---|---|
| DE | 30 27 374 | A1 | 2/1982 |
| DE | 40 24 081 | A1 | 1/1992 |
| DE | 196 04 329 | A1 | 8/1997 |
| DE | 10 2006 008 505 | A1 | 8/2007 |
| JP | 2011-009355 | A | 1/2011 |
| WO | WO 85/04083 | A1 | 9/1985 |
| WO | WO 03/093619 | A1 | 11/2003 |

* cited by examiner

*Primary Examiner* — Daniel J Troy
*Assistant Examiner* — Timothy M Ayres
(74) *Attorney, Agent, or Firm* — Birch, Stewart, Kolasch & Birch, LLP

(57) ABSTRACT

An item of furniture comprises a stationary furniture part, a furniture part which can be moved by a drive, and a controller for controlling the drive. The movable furniture part comprises an operating section which is arranged movably on a main part of the movable furniture part, and also at least one force sensor for measuring a force which is exerted on the operating section, wherein the force sensor is connected to the controller.

20 Claims, 4 Drawing Sheets

ITEM OF FURNITURE WITH A MOVABLE FURNITURE PART

TECHNICAL FIELD

The invention relates to an item of furniture comprising a stationary furniture part, a furniture part which can be moved by a drive, and also a controller for controlling the drive.

PRIOR ART

Various items of furniture with furniture parts which can be adjusted by drives are known, for example tables with a vertically adjustable tabletop, drawers with motorized opening and/or closing means, or beds with elements which can be adjusted by motor. In addition to the drive and a controller for controlling the drive, elements with which the user can control the controller and therefore the movement of the movable furniture part are required. Said elements may be simple operating elements, for example buttons with which a desired direction of movement can be selected. Elements of this kind can be operated in a simple and intuitive manner, but allow only few and simple operations.

By way of example, DE 40 24 081 A1 (OTM-Möbelwerke Helmut Seidel) describes a vertically adjustable table with a lifting device for raising and lowering the tabletop. In order for the table to be adjusted without force being exerted, the lifting device is driven by an electric motor. Switches for controlling the movement are arranged on the lower face of the tabletop. The motor is in each case switched on for as long as the corresponding button is operated by the hand of the user.

A wider variety of options are provided by more complex controllers which are likewise known and have a large number of operating elements (or even a touchscreen) and temporary stores for desired positions which are to be moved to. However, operation of these devices is not very intuitive. It requires a certain amount of familiarity or even training of the user. This is not really a problem for complex items of furniture, for example operating tables, which are used by trained personnel. However, the ability to operate in an intuitive and ergonomic manner is desired in items of furniture which are of inherently simple construction, for example vertically adjustable tables.

DE 10 2006 008 505 A1 (Siemens) discloses an operating table with a tabletop which can be moved manually and by means of a motor. At least one sensor for determining the force which is exerted on the tabletop by a user for moving the tabletop is provided on the tabletop. The motor is used to assist the manual force and is controlled in dependence on the sensor signal taking into account a predetermined reference force value, with the result that the manual force does not exceed the reference force value. The reference force value is set such that a specific table mass and table friction are virtually simulated for the user. The sensor for determining the exerted force, for example a strain gauge sensor, is fitted directly on the tabletop, for example in a handling section which is to be acted on by the user.

This publication therefore proposes measuring the operating force which is exerted on the movable furniture part by the user and assisting this operating force by virtue of the drive in such a way that a certain maximum force is not exceeded—that is to say the operator control process changes in comparison to manual adjustment only in as much as the operating forces are reduced. Therefore, operator control is intuitive.

However, implementation of this concept is complicated and not equally suitable for all items of furniture. A specific handling section is required, this handling section having to be equipped with a force sensor for directly detecting the operating force.

JP 11 009 355 A2 (Yamaha Living Tec) discloses a device, for example a dishwasher, having an external housing and an internal part which can be moved in relation to this external housing in the vertical direction by means of a drive. A handle is arranged in a rotatable manner on a base plate of the internal part. The force which is exerted by a user on the handle is measured and the movement of the internal part is controlled in dependence on the measured force.

Therefore, instead of buttons, an operator control element which is known per se, specifically a handle, is used as the operating element. The drive therefore assists the "natural" operation by the user. Operator control is again intuitive.

However, not all items of furniture which are to be automated comprise known operator control elements of this kind which could change function. The additional attachment of operator control elements of this kind is often esthetically unsatisfactory. It is also often not desirable to design operator control elements which are known and are generally arranged fixedly on the item of furniture to be movable because the mobility may suggest poor quality ("wobbling").

SUMMARY OF THE INVENTION

The object of the invention is to provide an item of furniture which forms part of the technical field cited in the introductory part, has esthetic qualities and allows simple and intuitive operation of a drive for the movable furniture part.

The object is achieved by the features of claim 1. According to the invention, the movable furniture part comprises an operating section which is arranged movably on a main part of the movable furniture part. Furthermore, at least one force sensor for measuring a force which is exerted on the operating section is provided and connected to the controller.

Since operation is performed by means of a part of the movable furniture part, no additional operating elements (such as buttons, handles or the like) are required, and therefore the esthetics are not adversely affected. The movable arrangement of the operating section allows for simple arrangement of the force sensor and simple force measurement.

The operating section can be arranged on the movable furniture part in such a way that its mobility relative to the main part is not visible and also cannot be felt, or can hardly be felt, during operation. The operating section is therefore an integral part of the movable furniture part. A small movement of the operating section relative to the main part is adequate to allow force measurement.

By virtue of the arrangement according to the invention, the operating section can be integrated in the design of the item of furniture in such a way that it cannot be seen as such from the outside. However, in order to indicate the option of operation to the user, it can also be distinguished by virtue of color, by virtue of a texture, the choice of material and/or its shape. It is likewise possible to distinguish the transition between the main part and the operating section by virtue of one or more of said means.

In a preferred embodiment of the invention, the movable furniture part is a tabletop, and the operating section is a region of this tabletop. Tabletops do not usually comprise common operator control elements for vertical adjustment. Since the operating section forms an integral part of the tabletop, it is not readily visible and does not have any disturbing influence on the esthetics of the tabletop. The operating section can be designed, for example, such that a continuous and transition-free upper table surface is present, said table surface being formed jointly by the main part and the operating section. The operating section therefore forms part of the tabletop, which part (at least substantially and to the extent that it is visible to the user) merges with the main part without a transition. By way of example, a kind of hinge (with a short pivot distance) can be provided at the transition, said hinge forming a pivot axis at the transition of the two parts. Exerting a force on the operating section then leads to slight tilting of the corresponding main plane in relation to the main plane of the main part about said pivot axis. A fraction of a degree, which is neither optically nor haptically identifiable by the user, is sufficient given suitable design of the hinge and of the force sensor.

The operating section is particularly preferably formed by an edge region, in particular a corner region of the tabletop. A region of this type can be easily reached by the user for operation, and is additionally structurally simple to realize because the transition between the main part and the operating section can be made along a straight line. In the corner region, the user can additionally act on the tabletop both on the side edge and on the longitudinal edge. Therefore, the operating section can always be reached irrespective of the setup of the table and the user can generally select his preferred, and therefore ergonomic, direction of action.

In order to improve ergonomics and/or esthetics, the corner region can be beveled or rounded. It can also be chamfered in a different way.

The tabletop advantageously comprises a weak point with a reduced cross section at a transition between the main part and the operating section. It is therefore possible to provide a hinge (or a predetermined bending point), and therefore an operating section which can move in relation to a main part, in the manner of a solid joint in a simple manner and without additional elements such as joints or bearings, wherein the desired mobility, that is to say the expenditure of force which is desired for a predefined movement distance, can be predefined by the dimensioning of the weak point. The weak point can be formed, for example, by a milled-out portion on the lower face of the table.

The invention is not restricted to vertically adjustable tables, it can also be realized in connection with other items of furniture, for example self-propelled bodies, vertically adjustable beds etc.

The item of furniture preferably comprises an activation element, wherein the controller can be switched from a first operating state to a second operating state by operation of the activation element, wherein a force which is exerted on the operating section does not trigger any movement of the furniture part in the first operating state, and wherein a force which is exerted on the operating section triggers a movement of the furniture part in the second operating state. Therefore, an action on the operating section does not lead directly to movement of the movable furniture part in every case. Since the operating section forms part of the movable furniture part, a movement of this type is not always desired when a force is exerted on the section.

In a preferred embodiment, the activation element functions in the manner of a button, wherein the controller is in the second operating state for as long as operation of the activation element is established.

As an alternative, brief operation of the activation element leads to a switchover to the respectively other operating state. The activation element can also be designed in the form of a switch, with the result that said activation element can be switched back and forth between one and the other operating state.

In a further embodiment of the invention, first operation of the activation element leads to the switchover to the second operating state. The controller then automatically switches the second operating state to the first operating state after a first predefined time after operation of the activation element has elapsed if no operation of the operating section is identified within this first predefined time. If operation is performed, the controller automatically switches the second operating state to the first operating state after a second predefined time after last operation of the operating section has elapsed. This manner of operation makes it possible for only activation by operation of the activation element, for example by briefly tapping a button, to be required within the scope of operator control for vertical adjustment. Changeover to the first (deactivated) operating state is always automatic. The first predefined time and the second predefined time can be identical or different. For example, the controller can be programmed such that vertical adjustment is activated for 4 secs after the activation element is tapped, that is to say in the event of action on the operating section, the movable furniture part moves over the following four seconds. If the user no longer acts on the operating section for a time of, for example, 2 secs or no action is performed over said 4 secs, the controller again switches over to the first operating state. Renewed activation is required for (further) vertical adjustment.

The controller is advantageously designed in such a way that measurement values of the at least one force sensor are evaluated in the second operating state in order to control the drive. The force sensor therefore supplies not only a digital two-value signal (operation yes/no), but a force value which can be processed further. This allows, for example, a force threshold value which has to be overcome when adjustment is intended to be performed to be defined or allows further-reaching differentiation in the control of the movement.

A speed of the movement of the furniture part is, in particular, preferably controlled in dependence on a value of the measured force, wherein a direction of movement is substantially parallel to a direction of the measured force. The user can therefore finely adjust the movement of the movable furniture part by virtue of the force exerted by him on the operating section and the direction is chosen intuitively by the exertion of a force which is directed substantially in the desired direction. Depending on the option to move, only one force component is taken into account: if the item of furniture is, for example, a vertically adjustable table, it being possible for the tabletop of said table to move downward and upward in the vertical direction, only the vertical force component is evaluated or even detected at all. This has the result, for example, that movement of the operating section is possible substantially along this direction. If the vertical force component is directed upward, the table is raised; if said vertical force component is directed downward, said table is lowered. However, more complex control processes are also possible, for example in the case of two-dimensionally adjustable furniture parts. In these cases, additional force components are accordingly detected and taken into account.

The controller preferably stores a reference force when it is switched to the second operating state, and subsequent control of the movement of the furniture part is performed in dependence on a difference between a currently measured force and the reference force. As a result, automatic calibration is achieved with each activation operation, that is to say, even when the zero force changes given a lack of operation of the operating section (for example on account of material aging or because constant forces which are independent of the operating process act on the operating section), the controller always takes the actual operating force into account.

As an alternative, this measure can be dispensed with, in particular when it is unlikely that, for example, objects will be placed on the operating section or additional elements will be fastened to it. Finally, it is also possible to provide the option of calibration as desired by the user or when the table is being serviced, for example by the activation element being operated over a certain minimum time or by an additional operator control element being operated, for example a switch which is arranged on the control electronics and can be reached from the outside by a thin tool (screwdriver, ballpoint pen).

The activation element preferably comprises a capacitive switching element. Said switching element can be integrated in a movable furniture part in a simple and inconspicuous manner. Furthermore, it does not react to purely mechanical influences such as pressure, but rather substantially to the change in capacitance which results when, in particular, the hand of a user approaches. Finally, said switching element is hardly subject to wear.

The activation element is advantageously arranged in the operating section. This results in a simple design with short signal paths and intuitive operator control for the user since he can perceive both activation and control of the movement with the aid of the operating section.

The item of furniture preferably comprises an indicator element for indicating the second operating state. As a result, the user identifies whether the item of furniture is in the activated state or not. Faulty operator control operations can therefore be avoided. The indicator element can be, in particular, an optical indicator element, but acoustic or haptic elements are also feasible. The indicator element can indicate the activated and/or the deactivated state and/or the switchover from one operating state to the other.

Elements of the controller (for example electronic components) are advantageously accommodated in a receptacle in the movable furniture part. The entire controller is ideally accommodated in a receptacle of this kind (or a plurality of receptacles of this kind). As a result, the controller can be completely concealed and at the same time is protected against environmental influences. The signal paths can be short by virtue of said controller being fitted in the vicinity of the force sensor and possibly of the activation switch. In a particularly preferred embodiment, the operating section comprises a receptacle in which both the controller and also the force sensor and the activation switch and the connections between said components are accommodated.

In a preferred embodiment, the indicator element comprises a light source which is arranged in the receptacle (for example an LED), and a light guide which issues into an edge of the item of furniture and displays light from the light source on an outer face of the item of furniture. This design is robust and allows the indicator element to be realized in an inconspicuous manner with esthetic qualities.

An indicator element is not compulsory. If, for example, the activation element is designed such that, in the event of customary operation of the vertical adjustment, it responds by exerting a force on the operating section, an indicator element can be dispensed with.

The at least one force sensor advantageously comprises at least one strain gauge which is arranged at the transition between the operating section and the main part of the movable furniture part. It is fitted such that it can detect forces on account of a relative movement between the two parts. A strain gauge is highly suitable for detecting the change in shape between the main part and the operating section. Said strain gauge can be arranged, for example, on a carrier element which is fixedly connected, in sections, to the main part and to the operating section. A relative movement between the two parts then leads to deformation of the carrier element, and this deformation can be measured by means of the strain gauge.

Further advantageous embodiments and combinations of features of the invention can be found in the following description of a detail and in all of the patent claims.

BRIEF DESCRIPTION OF THE DRAWINGS

In the drawings which are used to explain the exemplary embodiment.

In principle, identical parts are provided with the same reference symbols in the figures.

WAYS OF IMPLEMENTING THE INVENTION

Figure 1:
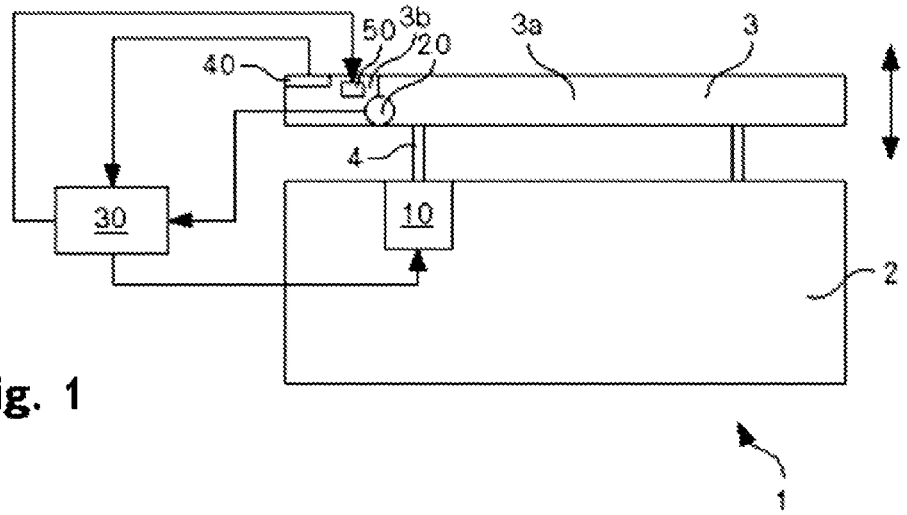
FIG. 1 shows a block diagram of an item of furniture according to the invention with a movable furniture part.

FIG. 1 is a block diagram of an item of furniture according to the invention with a movable furniture part. The item of furniture 1 comprises a stationary furniture part 2, for example a table frame, and an item of furniture 3, for example a vertically adjustable tabletop, which can move in relation to said stationary furniture part. Vertical adjustment is performed by means of a drive 10, for example an electric motor, which acts on a spindle of a lifting column 4 in a manner which is known per se.

Figure 2:
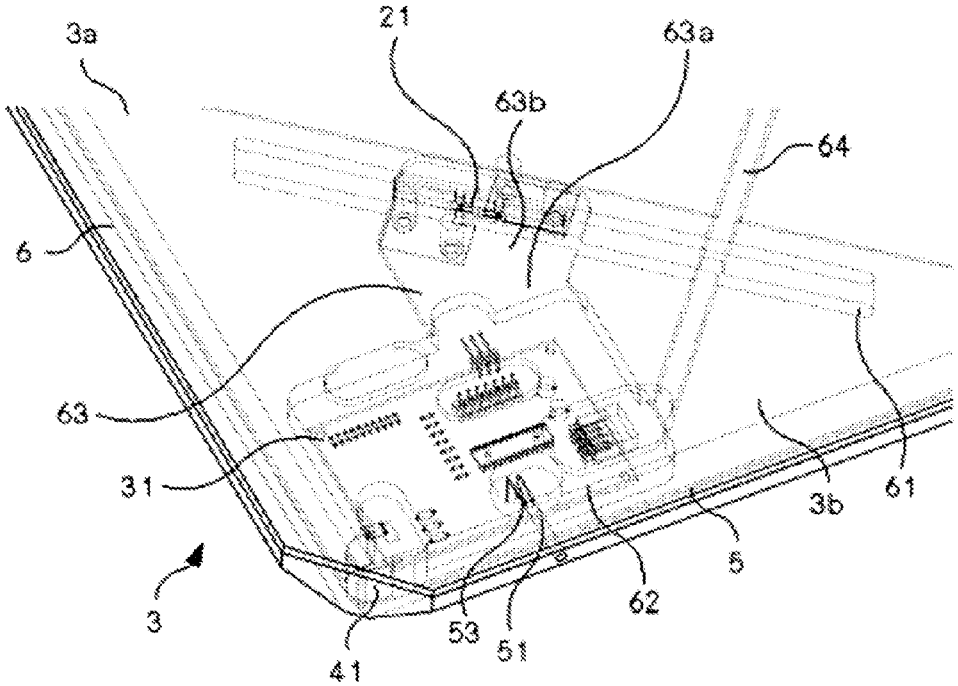
FIG. 2 shows a perspective illustration of the confirmation section of the item of furniture according to the invention.
Figure 3:
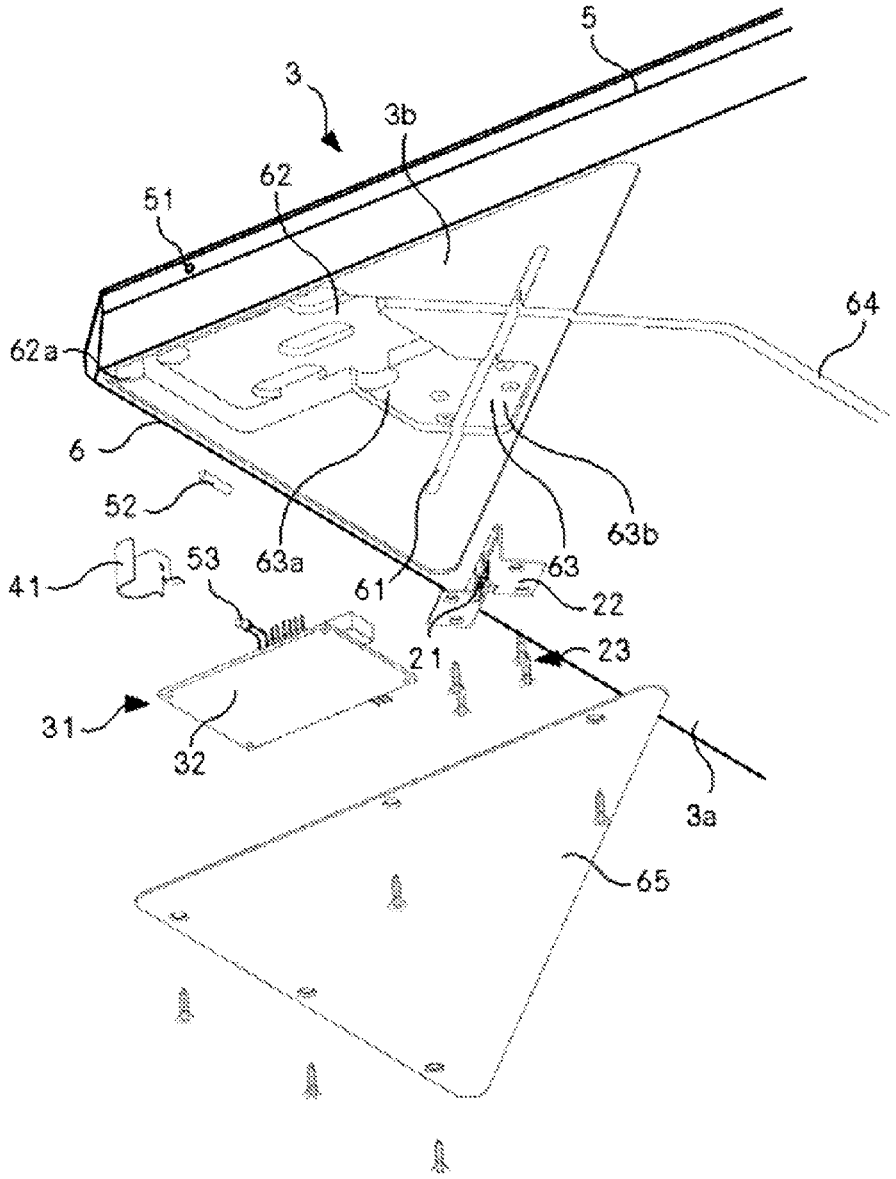
FIG. 3 shows a partially exploded illustration of the operating section.

The movable furniture part 3 comprises a main part 3*a* and an operating section 3*b* which can move in relation to said main part, as described in greater detail further below in connection with FIGS. 2 and 3. The force which is exerted on the operating section 3*a* in the event of a relative movement of the operating section 3*b* in relation to the main part 3*a* is detected by a force sensor 20 which is arranged at the transition between the operating section 3*b* and the main part 3*a*. The measurement values of the force sensor are transmitted to a controller 30 which controls, amongst other things, the drive 10 for vertical adjustment.

An activation switch 40 and an activation indicator 50, which are both arranged in the operating section 3*b*, are likewise coupled to the controller 30. The power supply for the drive 10, the controller 30, the activation indicator 50 and any further components which are to be supplied with electrical energy are not illustrated. Said power supply is designed in a customary manner.

In the illustrated exemplary embodiment, the operating section 3*b* forms the front (that is to say the user-facing) left-hand corner region of a tabletop 3 of a vertically adjustable table 1. FIG. 2 is a perspective illustration of the operating section as seen from above. In order to improve the illustration, the tabletop is illustrated as being partially transparent. FIG. 3 shows a partially exploded illustration of the operating section from below.

A milled-out portion 61 runs obliquely, at an angle of approximately 45° in relation to the side edges of the tabletop 3, between the operating section 3*b* and the main part 3*a* of the tabletop 3 and extends from the lower face of the tabletop 3 partially into said tabletop. In this case, the milled-out portion 61 runs virtually from the longitudinal edge to the lateral edge of the tabletop 3. This creates a kind of solid joint, wherein the geometries of the milled-out portion 61 together with the materials of the tabletop 3 and further involved elements define the bending zone and strength of the corner and therefore the expenditure of force for a (slight) relative movement between the operating section 3*b* and the main part 3*a*. The arrangement of the milled-out portion 61 allows operation both from the (left-hand) side and from the front. By selecting a different angle, for example an angle of 35° in relation to the longitudinal edge of the table, the proportion of the longitudinal edge which is included in the operating section can be increased, this simplifying operator control on the front edge of the table.

An approximately rectangular recess 62 is also milled out in the operating section 3*b*, said recess likewise running from the lower face of the table partially into the tabletop 3. In the corner region of the tabletop, the recess 62 is supplemented by a cylindrical part 62*a*. Moreover, the cross section of the tabletop 3 is slightly reduced on the lower face in the entire region of the operating section 3*b*. The substantially triangular section with a reduced cross section runs beyond the milled-out portion 61.

A further milled-out portion 63 with a lower depth than the milled-out portion 61 runs from the recess 62 to the milled-out portion 61. The further milled-out portion 63 runs from the operating section 3*b* to the main part 3*a*. It comprises a first section 63 which issues perpendicularly into the rear longitudinal side of the recess 62, and also a second section 63*b* which adjoins the first section 63*a* at an angle of approximately 45° and perpendicularly crosses the central region of the milled-out portion 61. A further milled-out portion 64 in the form of a channel runs, starting from the substantially rectangular recess 62, perpendicularly through the milled-out portion 61, into the main part 3*a* of the tabletop 3.

The tabletop 3 is enclosed by edge strips 5, 6. Said edge strips are chamfered at their ends which meet one another, with the result that the corner of the tabletop 3 has a chamfered corner overall. A cover, for example composed of synthetic resin, linoleum, or a wood veneer, is arranged on the tabletop 3 such that it is enclosed by edge strips and covers the entire table surface (main part 3*a* and operating section 3*b*). Said cover forms the useful surface of the table 1.

A strain gauge 21 is accommodated in the second section 63*b* of the further milled-out portion 63 as the force sensor. Said strain gauge is mounted on a carrier element 22 which is realized in the form of a bent sheet-metal part. Said bent sheet-metal part is shaped such that it produces a central bending bar and two fastening lugs which, starting from the same longitudinal edge of the bending bar, project perpendicularly to said bending bar into opposite directions. The two fastening lugs each comprise two fastening openings. The support element 22 can be fastened in the recess 63 by means of screws 23 which are routed through said openings, wherein one lug is fixedly connected to the main part 3*a* of the tabletop 3 and the other lug is fixedly connected to the operating section 3*b* of the tabletop 3. The bending bar which is directed perpendicularly to the main plane of the tabletop 3 is accommodated in the milled-out portion 61 in the fastened state.

The action of force on the operating section 3*b* leads to a relative displacement between the two fastening lugs, this causing an S-shaped deformation in the bending bar. This deformation in the bending bar is measured with the aid of the strain gauge 21 which is fixedly arranged on the bending bar.

The strain gauge 21 is connected to control electronics 31 by means of a cable. Said control electronics is mounted on a base plate 32 (PCB) which is accommodated in the recess 62 and is fastened to the tabletop 3 by means of four screws. The recess 62 comprises regions of relatively great depth for accommodating certain components of the control electronics 31. The control electronics 31 comprises, amongst other things, suitable modules for amplifying and propagating the sensor signals, and also a central control unit for processing the sensor signals and for generating control signals for the activation indicator and the drive. An antenna 41 is accommodated in the cylindrical part 62*a* of the recess 62, said antenna substantially being in the form of a sheet-metal part which is bent in a U-shaped manner. Said antenna acts as a capacitive proximity sensor in a manner which is known per se. The antenna 41 is also connected to the control electronics 31.

Cables for the power supply and the control signal for the drive and also the pulse signal of the corresponding motors are inserted into the channel-like milled-out portion 64. Said cables run from the control electronics 61, through the channel, to corresponding openings in the lower face of the tabletop. Said cables are routed through said openings to the corresponding components.

Finally, a cylindrical bore 51 runs parallel to the main surface of the tabletop and through the tabletop and the longitudinal edge strips 5, said cylindrical bore issuing into the recess 62 for the control electronics 31 and exiting through the front face of the edge strips 5. A cylindrical acrylic glass rod is accommodated in said bore 51 as the light guide 52. The control electronics 31 comprises a white LED light source 53 which is arranged on the base plate in such a way that its light can be conducted through the light guide 52 to the front face of the edge strip 5, with the result that the activation indicator 50 is formed there.

The milled-out portions 61, 63 and the recess 62 in the operating section 3*b* and the components accommodated therein are concealed by a base plate 65 which is formed from sheet metal, is grounded and of which the thickness corresponds to the reduction in the cross section in the corner region, with the result that the lower face of the table is substantially continuous. The base plate 65 is screwed to the tabletop 3 in its edge region by a plurality of screws. The screws are arranged along the side edge and the longitudinal edge of the tabletop 3, with the result that the base plate 65 does not unduly restrict the mobility of the operating section.

Figure 4A:
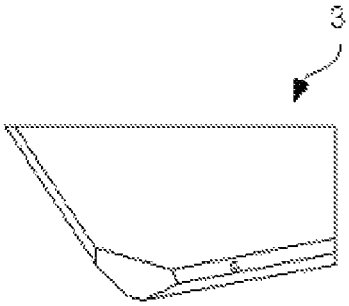
FIGS. 4A-E show an illustration of a sequence of operator control actions by a user.

FIGS. 4A-E schematically show a sequence of operator control operations performed by a user. FIG. 5 shows a flowchart of the sequence of events in the controller 30. The starting position is schematically illustrated in FIG. 4A. The vertically adjustable tabletop 3 is at a certain initial height. Vertical adjustment is deactivated (step 101), this being indicated by the activation indicator 50 being dark (step 102). The controller 30 is in a standby mode in which operations of the activation switch 40 are detected.

Figure 4B:
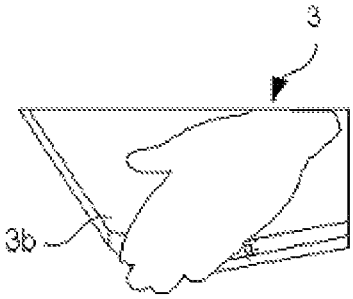
Figure 4C:
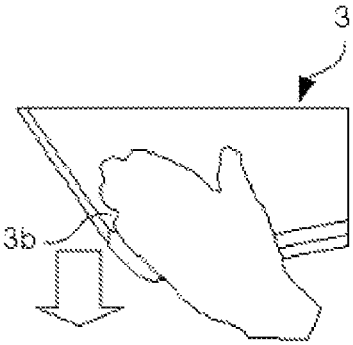
Figure 4D:
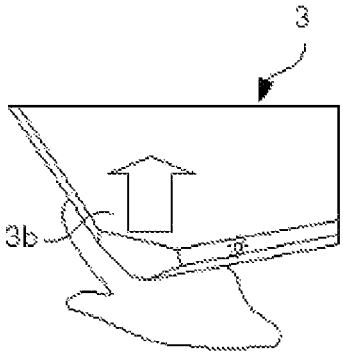
Figure 5:
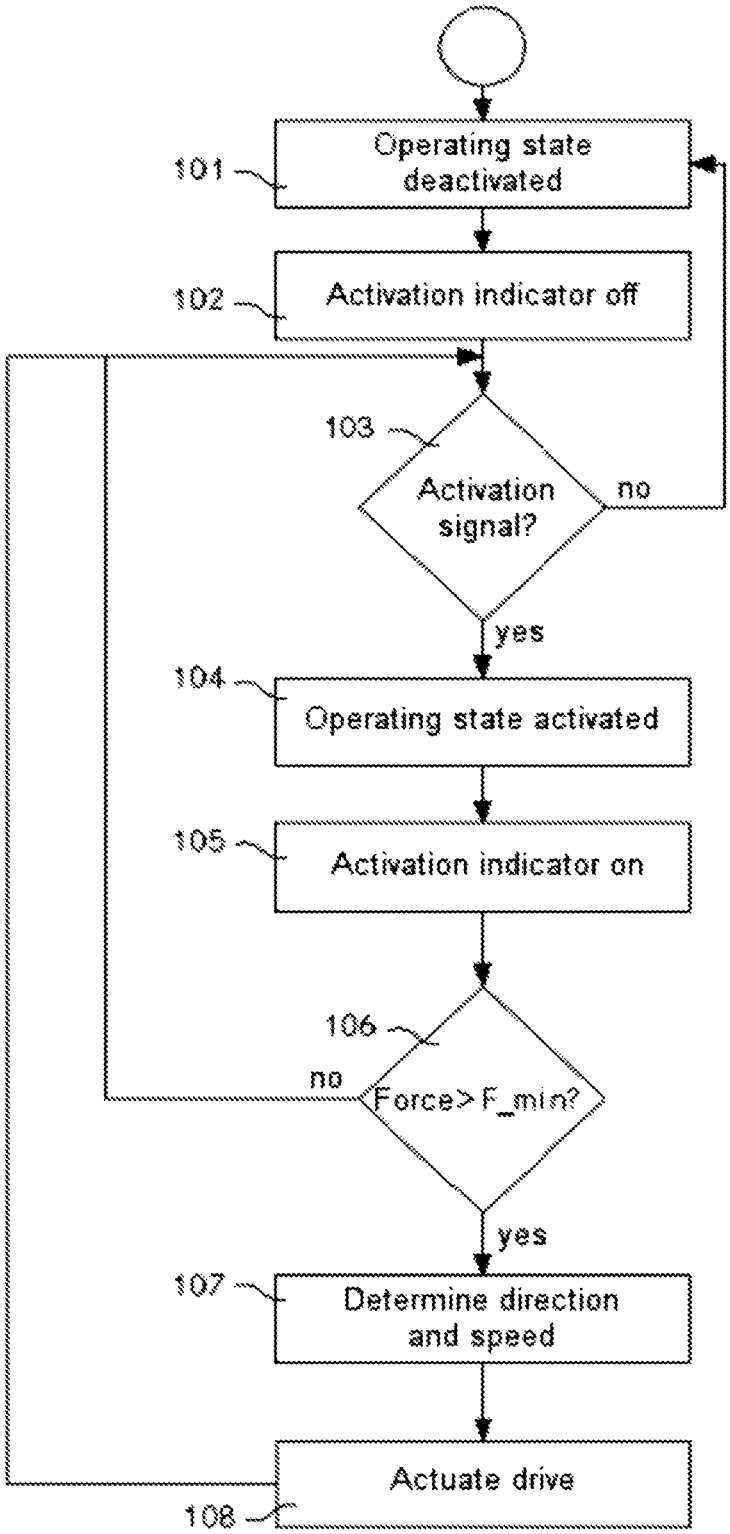
FIG. 5 shows a flowchart of the sequence of events in the controller of the item of furniture according to the invention.

A user now activates the vertical adjustment by moving his hand toward the corner of the table, as illustrated in FIG. 4B. The antenna 41 of the activation switch 40 detects this approach and transmits the corresponding information to the controller 30. As soon as said controller establishes an approach (decision 103), said controller switches over to an activated operating state (step 104). Otherwise, the operating state remains deactivated. The activated operating state is indicated to the user—as indicated in FIG. 4B—by an illuminated activation indicator 50 (step 105). The activation ensures that unintentional operations when exerting a force on the operating section are avoided.

As long as the controller is in the activated operating state, the activation indicator 50 is illuminated. The user can also move the table downward or upward for this period by exerting a downwardly directed force (FIG. 4C) or an upwardly directed force (FIG. 4D): the exerted force leads to a minimal change in the angle between the main part 3*a* of the tabletop 3 and the operating section 3*b*. This change in angle leads to a force on the strain gauge 21. The corresponding measurement value is detected by the controller 30 and converted by means of the drive 10 into a movement of which the direction corresponds substantially to that of the force which is exerted by the user on the operating section 3*b* (step 108).

In this case, the controller 30 distinguishes between three value ranges of the magnitude of the detected force. Below a certain minimum force F_min, the drive is not actuated and vertical adjustment does not take place (decision 106). In a middle range, the speed of the vertical adjustment is controlled in dependence on the operating force, wherein a relatively high operating force also leads to an increased speed. Various force profiles (linear, progressive, degressive) are possible. At an upper limit force, the height of the tabletop 3 is changed at a predefined maximum speed (step 107). Even if a higher force than the upper limit force is measured, the adjustment continues to be performed at this speed.

The movement is stopped when the detected force falls below the minimum force, when an upper or lower end position of the tabletop is reached, when the activation switch 40 is no longer operated or when a collision with an obstacle is detected. Detection of this kind can be performed by means of means (not illustrated in this case) which are known per se, for example by monitoring the current consumption by the drive motor.

Figure 4E:
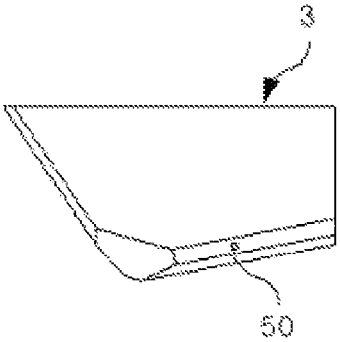

Deactivation, that is to say switching the controller 30 to the corresponding operating state, is performed when operation of the activation switch 40 is no longer established, that is to say the user removes his hand from the corner region (decision 103). FIG. 4E shows this target state which—with the exception of a possible change in table height—again corresponds to the state according to FIG. 4A. Renewed activation is required for a (further) vertical adjustment.

The invention is not restricted to the illustrated exemplary embodiment. In particular, details of the structural configurations, for example the geometries of the milled-out portions and recesses or the positioning of the individual operator control and indicator elements, can be designed differently. For example, given suitable dimensioning of the cover, the milled-out portions can pass through the entire tabletop and be covered only by the cover on the upper face. The components which are accommodated in a milled-out portion may be visible from above in sections, for example indicator elements for the current table height or for the activation. In one possible embodiment, the control electronics comprise a 7-segment display (for example for three numerals) which is visible through an aperture in the upper face of the table. The display is covered, for example, by a black clock glass which runs substantially in the plane of the table surface. The 7-segment display allows, for example, the current table height to be displayed.

The force-dependent controller can be combined with further control elements, for example with customary buttons or with remote operator controller. In addition to the manual selection of height, provision can also be made to set up predetermined or freely configurable heights. Furthermore, the used sensors and indicator elements can, in particular, also be based on other technologies.

As already mentioned, the invention is additionally not restricted to vertically adjustable tables, but can also be used in connection with other items of furniture.

In summary, it is to be stated that the invention provides an item of furniture with a furniture part which can be moved by a drive, said item of furniture having esthetic qualities and allowing simple and intuitive operation of the drive.

The invention claimed is:

1. An item of furniture comprising a) a stationary furniture part, b) a furniture part which can be moved by a drive, c) a controller for controlling the drive, wherein d) the movable furniture part comprises an operating section which is arranged movably on a main part section of the movable furniture part, e) at least one force sensor for measuring a force which is exerted on the operating section, and is connected to the controller, f) the item of furniture further comprising a bending zone in which the operating section and the main part section form an initial plane and the operating section bends out of the initial plane, wherein the force sensor is mounted in the bending zone such that it measures the force based on the amount of bending of the operating section out of the initial plane, and the controller controls the drive based on a value of the measured force indicative of the amount of bending.

2. The item of furniture as claimed in claim 1, wherein an activation element, wherein the controller can be switched from a first operating state to a second operating state by operation of the activation element, wherein a force which is exerted on the operating section does not trigger any movement of the furniture part in the first operating state, and wherein a force which is exerted on the operating section triggers a movement of the furniture part in the second operating state.

3. The item of furniture as claimed in claim 2, wherein the controller is designed in such a way that measurement values of the at least one force sensor are evaluated in the second operating state in order to control the drive.

4. The item of furniture as claimed in claim 3, wherein a speed of the movement of the furniture part is controlled in dependence on a value of the measured force, wherein a direction of movement is substantially parallel to a direction of the measured force.

5. The item of furniture as claimed in claim 3, wherein the controller stores a reference force when it is switched to the second operating state, and subsequent control of the movement of the furniture part is performed in dependence on a difference between a currently measured force and the reference force.

6. The item of furniture as claimed in claim 2, wherein an activation element comprises a capacitive switching element.

7. The item of furniture as claimed in claim 2, wherein an activation element is arranged in the operating section.

8. The item of furniture as claimed in claim 2, wherein an indicator element for indicating the second operating state.

9. The item of furniture as claimed in claim 8, wherein an indicator element comprises a light source which is arranged in the receptacle, and a light guide which issues into an edge of the item of furniture and displays light from the light source on an outer face of the item of furniture.

10. The item of furniture as claimed in claim 1, wherein elements of the controller are accommodated in a receptacle in the movable furniture part.

11. The item of furniture as claimed in claim 1, wherein at least one force sensor comprises at least one strain gauge which is arranged in the bending zone that is at the transition between the operating section and the main part of the movable furniture part.

12. The item of furniture as claimed in claim 4, wherein the controller stores a reference force when it is switched to the second operating state, and subsequent control of the movement of the furniture part is performed in dependence on a difference between a currently measured force and the reference force.

13. The item of furniture as claimed in claim 3, wherein an activation element comprises a capacitive switching element.

14. An item of furniture comprising a) a stationary furniture part, b) a furniture part which can be moved by a drive, c) a controller for controlling the drive, wherein d) the movable furniture part comprises an operating section which is arranged movably relative to a main section of the movable furniture part, e) at least one force sensor for measuring a force which is exerted on the operating section, and is connected to the controller, wherein the movable furniture-part is a tabletop, and the operating section is a region of this tabletop, the item of furniture further comprising a bending zone in which the operating section and the main section form an initial plane and the operating section bends out of the initial plane, wherein the force sensor is mounted in the bending zone such that it measures the force based on the amount of bending of the operating section out of the initial plane, and the controller controls the drive based on a value of the measured force indicative of the amount of bending.

15. The item of furniture as claimed in claim 14, wherein the operating section is formed by a corner region of the tabletop.

16. The item of furniture as claimed in claim 15, wherein the tabletop comprises a weak point with a reduced cross section at a transition to the operating section.

17. The item of furniture as claimed in claim 14, wherein the tabletop comprises a weak point with a reduced cross section at a transition to the operating section.

18. The item of furniture as claimed in claim 14, wherein an activation element, wherein the controller can be switched from a first operating state to a second operating state by operation of the activation element, wherein a force which is exerted on the operating section does not trigger any movement of the furniture part in the first operating state, and wherein a force which is exerted on the operating section triggers a movement of the furniture part in the second operating state.

19. The item of furniture as claimed in claim 15, wherein an activation element, wherein the controller can be switched from a first operating state to a second operating state by operation of the activation element, wherein a force which is exerted on the operating section does not trigger any movement of the furniture part in the first operating state, and wherein a force which is exerted on the operating section triggers a movement of the furniture part in the second operating state.

20. The item of furniture as claimed in claim 17, wherein an activation element, wherein the controller can be switched from a first operating state to a second operating state by operation of the activation element, wherein a force which is exerted on the operating section does not trigger any movement of the furniture part in the first operating state, and wherein a force which is exerted on the operating section triggers a movement of the furniture part in the second operating state.

* * * * *